US006305751B1

(12) United States Patent
Engström

(10) Patent No.: US 6,305,751 B1
(45) Date of Patent: Oct. 23, 2001

(54) CHAIR

(75) Inventor: Bengt Engström, Stockholm (SE)

(73) Assignee: Mercado Medic AB (SE)

( * ) Notice: Subject to any disclaimer, the term of this patent is extended or adjusted under 35 U.S.C. 154(b) by 0 days.

(21) Appl. No.: 09/462,783

(22) PCT Filed: May 12, 1999

(86) PCT No.: PCT/SE99/00825

§ 371 Date: Jan. 12, 2000

§ 102(e) Date: Jan. 12, 2000

(87) PCT Pub. No.: WO99/26379

PCT Pub. Date: Dec. 9, 1999

(30) Foreign Application Priority Data

May 15, 1998 (SE) ..... 9801756

(51) Int. Cl.[7] ..... A47C 7/02
(52) U.S. Cl. ..... 297/452.21; 297/452.33
(58) Field of Search ..... 297/411.2, 452.21, 297/452.23, 452.26, 452.28, 452.29, 452.3, 452.32, 452.33

(56) References Cited

U.S. PATENT DOCUMENTS 749,804 1/1904 Place .
3,279,853 * 10/1966 Cromwell et al. .
4,331,361 5/1982 Krakauer ..... 297/460
5,352,023 10/1994 Jay et al. ..... 297/452.21

FOREIGN PATENT DOCUMENTS 8303195 9/1982 (WO) .

* cited by examiner

*Primary Examiner*—Milton Nelson, Jr.
(74) *Attorney, Agent, or Firm*—Ostrolenk, Faber, Gerb & Soffen, LLP

(57) ABSTRACT

A chair (1), preferably of the type adapted for use by handicapped persons, comprising a seat (2), a back rest (3), a chair frame (4) supporting the seat (2) and the back rest (3) and arm rests (7) attached to the lateral or bottom portions (6) of the seat (2). The seat has a profile of normal thickness at the front but, at the rear, at the back rest (3), the seat has a depressed oval-shaped area (10) to match the anatomic shape of a seated human to permit the pelvis of the user to be received lower and more to the rear on the seat (2). Further, the underside of the back rest is curved upwardly. The sitting person is prevented from sliding forwards and the comfort of the seat (2) is increased.

4 Claims, 2 Drawing Sheets

Fig. 1
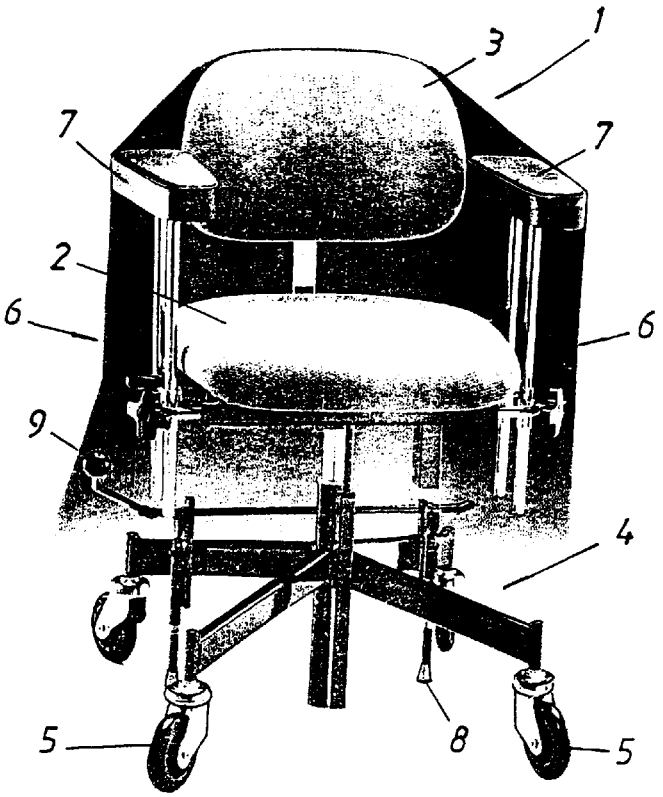
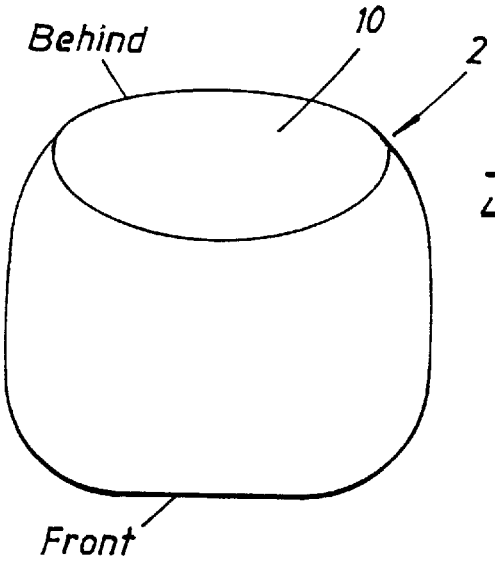
Fig. 2
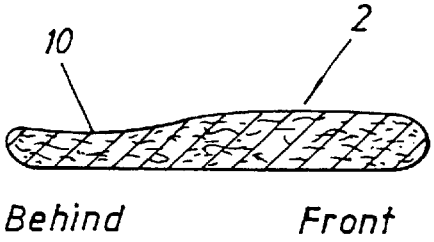
Fig. 3

CHAIR

BACKGROUND OF THE INVENTION

The present invention relates to a chair, preferably of the type adapted for use by handicapped persons, comprising a seat provided with upholstery, and a back rest, a chair frame supporting the seat and the back rest and having, or not, wheels and arm rests fixed in position to the lateral or bottom portions of the seat.

The chairs of the type mentioned above today available on the market suffer from problems as far as the seating comfort is concerned, especially when used by persons who remain seating in the chair for long periods of time. As far as the chair seat is concerned this part has so far not provided the pelvis of the user a satisfactory stability in the rear direction to the back rest. Further, the pressure against the tuberis ischiadicum in combination with the considerable shearing force relatively the seat amount to such a magnitude that the user experiences lack of comfort and so that the soft regions between the seat and the pelvis will get benumbed after some time in the chair. Other problems are that the lower portion of the back rest does not provide adequate space for the pelvis in the rear direction and that the back rest will exert a pressure against the pelvis so that the user tends to slip forwards on the seat and, in the worst case, may fall out of the chair.

When efforts have been made to rectify those problems by tilting the seat backwards, some of the problems are eliminated to a certain extent but, instead other problems will turn up, i.a. that the user assumes a posture too stabilizing backwards to allow him to be active forwards. Also, the tendency for the spine to get compressed does also increase significantly and, already after a few minutes, there arise great problems in the shape of tension in the muscles of the back of the neck. Further, the pressure exerted by the arms against the arm rests can get rather high if the person remains seating in this position for a longer period of time.

SUMMARY OF THE INVENTION

The object of the present invention is to provide an improved chair of the type mentioned above in which the above-mentioned drawbacks have been eliminated so that a handicapped person can experience an excellent support from both the seat, the back rest and the arm rests and always find himself in a comfortable position in the chair. The features characterizing the invention are set out in the subsequent claims.

Thanks to the invention there has now been provided a chair which in an excellent manner can perform its functions and which, at the same time, can be manufactured in a both simple and rational way. Thanks to the fact that, according to the invention, the rear portion of the seat below the user's pelvis has been lowered, it will better match the anatomic shape of a human "seating print". In this way the pelvis will be positioned at a lower level and somewhat more to the rear on the seat and the stability of the pelvis in the forward direction is increased which means that a backwards sliding in the chair is rendered more difficult. At the same time, the back rest will provide a good stabilization from the rear. In addition thereto the seat depth of the chair can be utilized in an optimal way. Due to the fact that the seat can be tilted forwards—not only when the user shall stand up but also to provide a more optimal working situation—the seat can have this form without causing muscular tensions in the user. The selection of such a seat shape also makes it simpler for the user to adjust the back rest so that it gets more functional as far as the upper part of the body is concerned. The shape of the back rest does, according to the invention, also provide an increased space for the lower portion of the pelvis at the bottom part of the back rest. This has been attained in the way that the lower part of the back rest is shaped so that it gets convex upwards resulting in a solution which makes the lowermost portion of the back rest softer, more flexible and space-providing. As far as the arm rests are concerned those do according to the invention at their upper, inner corners exhibit a centrally located, rounded inward bend somewhat lower, so that when the material in the arm rest is exposed to a load from above the inward bend can be compressed making the corner rounder and softer to the user.

BRIEF DESCRIPTION OF THE DRAWING

A preferred embodiment of the invention will now be described, reference being made to the annexed drawings.

FIG. 1 is a diagrammatic perspective view of a chair according to the present invention;

FIG. 2 is a diagrammatic top view of the seat of the chair illustrated in FIG. 1;

FIG. 3 is a diagrammatic, cross-sectional lateral view of the seat illustrated in FIG. 2;

DESCRIPTION OF A PREFERRED EMBODIMENT

Figure 4:
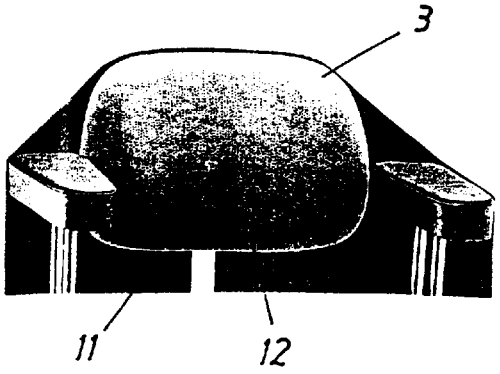
FIG. 4 is a diagrammatic perspective view of the back rest of the chair illustrated in FIG. 1.

As appears from FIG. 1 the subject of the invention according to the preferred embodiment is constituted by a chair 1, preferably of the type adapted for use by handicapped persons and comprising a seat 2, a back rest 3, a frame 4 supporting the seat 2 and the back 3 and, according to the example illustrated, provided with wheels 5 and with arm rests 7 mounted at the lateral portion 6 of the seat 2 in selected elevational positions. Frame 4 does also exhibit a braking device 8 which by means of a lever 9 can be activated by the user to fix the chair in a desired use position.

Figure 5:
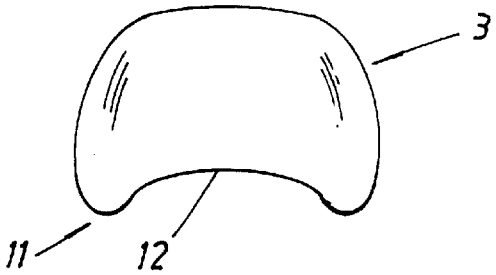
FIG. 5 is a diagrammatic view of the rear board forming part of the back rest in FIG. 4.

FIGS. 2 and 3 do diagrammatically show the seat 2, on one hand as seen from above and on the other hand in a lateral cross-sectional view. According to the preferred embodiment this seat is constituted by a supporting board on top of which there is mounted an upholstery which can be constituted by a polyurethane foam cushion the thickness of which is about 5–8 cms at the front and about 2–5 cms at the rear. It is held in position on the supporting board by means of a fabric cover. Accordingly, seat 2 exhibits a shape which at the front is of normal thickness but at the rear, in connection with the back rest 3, has a lower, oval-shaped portion 10 to match the anatomic shape of a human seating print in order to make it possible to receive the user's pelvis lower and more to the rear on the seat 2. In this way the user is protected from sliding forwards on the seat, the comfort of which is at the same time increased. Back rest 3 does also include an upholstery and exhibits a on a support board mounted upholstery of the same kind as on the seat 2. The larger portion thereof has a thickness of about 3–8 cms. The lower portion 11 of back rest 3 adjoining the seat 2 does, as has been illustrated in FIGS. 4 and 5, exhibit a central curvature 12 directed upwards to offer an increased space for the pelvis of the user and at the same time providing a softer and more flexible contact between the user and the back rest 3.

Figure 6:
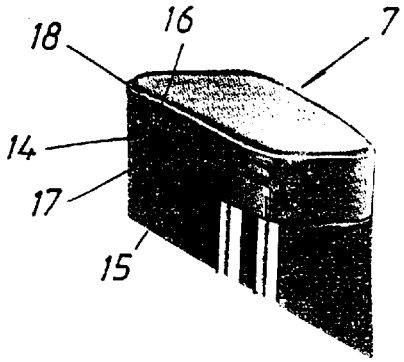
FIG. 6 is a perspective view showing the arm rest of the chair illustrated in FIG. 1 and shows the portion of the arm rest which, according to the invention, gets more rounded and hence more less presser-exerting upon being loaded.
Figure 7:
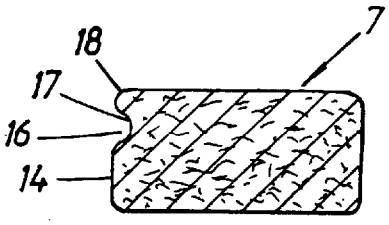
FIG. 7 is a cross-section through arm rest in FIG. 6 illustrating it in its unloaded condition.
Figure 8:
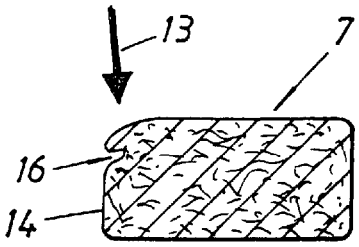
FIG. 8 is a cross-section corresponding to FIG. 7 but referring to a loaded condition.

FIGS. 6–8 do more in detail diagrammatically show the design of the arm rests 7 and their functions both in the unloaded and in the loaded condition. Thanks to the special design of the arm rests the inner corner becomes softer and rounder so that, when the user's arms are directed inwards, the pressure will not appear as unpleasant. The inner corner portions 14 of the arm rests 7 facing the chair seat 2 do, at least along their central sections 15, exhibit inward bends 16 in the shape of elongate recesses 17 in the upholstery material which can consist of polyurethane foam, the said recesses 17 being located immediately below the uppermost portion 18 of the edge corners 14. FIG. 7 illustrates the cross-sectional appearance of an arm rest 7 in an unloaded condition and FIG. 8 illustrates the appearance of arm rest 7 shown in FIG. 7 when in a loaded condition generated by a pressure in the direction of arrow 13.

What is claimed is:

1. A chair, comprising:

a chair frame; a seat on the frame, upholstery on the seat;

a back rest supported on the frame extending up and being above the seat;

the seat having a front which is away from the back rest and having a rear which is toward the back rest; the seat having a front profile toward the front of the seat and the front profile being of a first thickness, the seat having a rear profile toward the rear of the seat which defines a depressed oval shape area in the upholstery, giving the seat a second lower thickness at the depressed area for adaptation of the rear portion of the seat to a human's anatomic shape when sitting on the seat, for supporting a user's pelvis at the depressed area and toward the rear of the seat;

the back rest having a lateral center and having a lower portion directed toward the seat and having a shape that is curved upwardly toward the center of the back rest defining an increased space for the pelvis, whereby the depressed area of the seat together with the upward curve of the back rest tends to make the contact between the user and the back rest softer and more flexible and tends to prevent the user from sliding forward.

2. The chair of claim 1, further including wheels for the chair supported beneath the frame.

3. The chair of claim 1, further comprising arm rests supported by the frame and toward the sides of the back rest.

4. The chair of claim 3, wherein each arm rest extends from a front to a rear thereof; each of the arm rests has an inner comer portion that faces inward toward the chair seat and the inner corner portion has a central section between the front and the rear of the arm rest;

the inner corner portions of the arm rests at least along the central sections thereof have an uppermost portion of the inner comers and have recesses into the arm rests immediately below the uppermost portion of the arm rest, which enable the uppermost portions of the arm rest to be bent upon application of pressure.

* * * * *